US008027609B2

(12) United States Patent
Van Buren et al.

(10) Patent No.: US 8,027,609 B2
(45) Date of Patent: Sep. 27, 2011

(54) IMAGE FORMING APPARATUS FOR COUNTING IMAGES FORMED BY THE APPARATUS

(75) Inventors: Antonius C. M. Van Buren, Velden (NL); Alexander H. Venema, Ermelo (NL); Johannes T. M. Neggers, Best (NL)

(73) Assignee: Oce-Technologies B.V., Venlo (NL)

( * ) Notice: Subject to any disclaimer, the term of this patent is extended or adjusted under 35 U.S.C. 154(b) by 261 days.

(21) Appl. No.: 12/010,411

(22) Filed: Jan. 24, 2008

(65) Prior Publication Data

US 2008/0187329 A1 Aug. 7, 2008

(30) Foreign Application Priority Data

Jan. 24, 2007 (EP) ..... 07101082

(51) Int. Cl.
*G03G 15/00* (2006.01)
*G07C 3/00* (2006.01)

(52) U.S. Cl. ..... 399/79; 399/24; 399/38; 399/83; 377/15

(58) Field of Classification Search ..... 399/38, 399/42, 43, 75, 79, 80, 85; 377/15; 711/103; 358/1.13, 1.14, 1.16
See application file for complete search history.

(56) References Cited

U.S. PATENT DOCUMENTS 4,665,497 A * 5/1987 Yamamura et al. ..... 702/165
4,774,544 A * 9/1988 Tsuchiya et al. ..... 399/24
5,090,033 A * 2/1992 Murray-Shelley ..... 377/28
5,450,460 A 9/1995 Stodieck
5,479,467 A * 12/1995 Katsumata ..... 377/26
5,568,626 A * 10/1996 Takizawa ..... 711/103
5,818,501 A * 10/1998 Ng et al. ..... 347/240
5,878,298 A * 3/1999 Nakano ..... 399/24
6,216,245 B1 * 4/2001 Noda ..... 714/755
6,463,512 B2 * 10/2002 Isemura et al. ..... 711/160
6,798,695 B2 * 9/2004 Boeh et al. ..... 365/185.11
6,914,696 B1 * 7/2005 Kojima et al. ..... 358/1.16
7,203,434 B2 * 4/2007 Nakayama ..... 399/49
7,397,707 B2 * 7/2008 Mokhlesi ..... 365/185.33
2002/0071688 A1 * 6/2002 Maruyama ..... 399/45
2005/0074248 A1 * 4/2005 Akita et al. ..... 399/45
2005/0078973 A1 * 4/2005 Suzuki ..... 399/45
2006/0149896 A1 * 7/2006 Chang et al. ..... 711/103
2006/0216048 A1 * 9/2006 Fujii et al. ..... 399/45
2007/0071467 A1 * 3/2007 Mitsuya et al. ..... 399/45
2007/0150644 A1 * 6/2007 Pinto et al. ..... 711/103
2007/0300037 A1 * 12/2007 Rogers et al. ..... 711/202
2008/0019749 A1 * 1/2008 Suzuki ..... 399/389
2009/0094409 A1 * 4/2009 Yeh et al. ..... 711/103

FOREIGN PATENT DOCUMENTS

EP 0412039 A2 2/1991

* cited by examiner

*Primary Examiner* — David M Gray
*Assistant Examiner* — Francis Gray
(74) *Attorney, Agent, or Firm* — Birch, Stewart, Kolasch & Birch, LLP

(57) ABSTRACT

An apparatus having an operative mode and a non-operative mode with a method for counting events with a volatile counter and a non-volatile electronic memory having a number N of memory areas, includes counting events with the volatile counter, when the count value has been incremented by a predetermined number M or when the apparatus passes into the non-operative mode, saving the count value to one of the memory areas, with cycling switching of the memory area into which the count value is written; and when the apparatus passes into the operative mode, initializing the counter with the maximum of the count values stored in the N memory areas.

9 Claims, 4 Drawing Sheets

Fig. 2

| | counter | non-volatile memory area | | | |
|---|---|---|---|---|---|
| | | 0 | 1 | 2 | 3 |
| (a) | 892 | 800 | 880 | 892 | 720 |
| (b) | 905 | 800 | 880 | 892 | 720 |
| (c) | 972 | 800 | 880 | 972 | 720 |
| (d) | 1052 | 800 | 880 | 972 | 1052 |
| (e) | 1167 | 1132 | 1167 | 972 | 1052 |
| (f) | 1679 | 1600 | 19631 | 1440 | 1520 |
| (g) | 1600 | 1600 | 19631 | 1440 | 1520 |
| (h) | 1760 | 1680 | 1760 | 1440 | 1520 |

IMAGE FORMING APPARATUS FOR COUNTING IMAGES FORMED BY THE APPARATUS

CROSS-REFERENCE TO RELATED APPLICATIONS

This nonprovisional application claims priority under 35 U.S.C. §119(a) on Patent Application No. 07101082.1, filed in the European Patent Office on Jan. 24, 2007 the entirety of which is incorporated herein by reference.

BACKGROUND OF THE INVENTION

1. Field of the Invention

The present invention relates to an image forming apparatus, e.g. a copier or printer, implementing a method for counting the number of "clicks," i.e. the number copies that have been made.

2. Description of Background Art

In image forming apparatuses such as printers, copiers and multipurpose reproduction devices, it is frequently required to count the number of hard copies that have been made, e.g. for the purpose of determining suitable maintenance intervals, or, more importantly, for billing purposes. In conventional apparatus, mechanical counters are used for that purpose because such counters are known to be very robust and reliable. In particular, mechanical counters will retain their count values even in case of an unexpected power breakdown of the machine. On the other hand, since mechanical counters are relatively expensive, it would be desirable to replace them with electronic counters, while preserving a comparable level of robustness and reliability.

U.S. Pat. No. 4,774,544 discloses an image forming apparatus, wherein a method of the type described above is used for counting the number of copies. The "clicks" are counted by a CPU of the machine control, which comprises a non-volatile memory. An EEPROM (Electrically Erasable Programmable Read Only Memory) is provided as a non-volatile memory for saving the count values to make them persistent during those times when the power supply for the CPU is turned down. The contents of an EEPROM can be read as often as desired, but can be erased and re-written only a limited number of times. Since this number is significantly smaller than the number of copies that is expected to be made and to be counted during the total lifetime of the image forming apparatus, this EEPROM is subdivided into a plurality of memory areas each of which can store a complete count value, so that the storage capacity of the EEPROM is multiplied. Each time when a "click" is counted, the new count value is written in one of the memory areas of the EEPROM, and when the number of erase and write cycles of that memory area becomes exhausted, the future count values will be written into another memory area.

U.S. Pat. Nos. 5,568,626 and 5,450,460 disclose other counting methods dealing with the problem of the limited number of write cycles of an EEPROM.

However, all these methods require a considerable amount of storage capacity of the non-volatile memory, which increases the costs for these memory devices. Moreover, these known methods address the problem that the count values that are stored in the non-volatile memory may become corrupted only to a limited extent. Therefore, for example, when a machine error leads to an unexpected shutdown or when a power failure of the machine control system takes place at the very moment when new data are written into the EEPROM, the write procedure will be disturbed and the value that will be written into the memory area of the EEPROM becomes unpredictable. A similar problem will occur when an EEPROM or a specific memory area thereof reaches the end of its lifetime (earlier than expected).

U.S. Pat. No. 4,665,497 describes an odometer wherein a traveled distance is counted in a volatile counter, and certain increments of that distance, e.g. 100 m, are saved in a non-volatile memory having a plurality of memory areas. Another count value is saved when the power is switched off. When power is switched on again, the counter is initialized with the maximum of the count values read from the memory areas.

SUMMARY OF THE INVENTION

It is an object of the present invention to provide an apparatus having an operative mode and a non-operative mode, comprising a control system, adapted to perform a method for counting events with a volatile counter and a non-volatile electronic memory having a number N of memory areas. The method includes, when the apparatus passes into the operative mode, initializing the counter with the maximum of the count values stored in the N memory areas; counting events with the volatile counter; and saving the count value to one of the memory areas. The apparatus of the present invention reduces the costs for non-volatile memory devices and nevertheless is robust against various types of failure.

In order to achieve this object, according to the present invention, in the method of the apparatus the step of saving the count value is carried out when the count value has been incremented by a predetermined number M (M>1) or when the apparatus passes into the non-operative mode; and the N memory areas associated with the same counter are formed by distinct EEPROM's.

Since the various memory areas of the non-volatile memory are located in distinct EEPROM's, the counting system as a whole will be robust against events of damage or destruction even if some of the EEPROM's are affected.

Further, according to the method of the present invention, a write procedure in the non-volatile memory will not be required for each event that is to be counted. Instead, such a write procedure will be required only every M-th count. Therefore, for a given storage capacity of the non-volatile memory, the number of counts that can be stored persistently is multiplied by M. In case of a regular shutdown of the apparatus, i.e. when the apparatus passes from the operative mode into the non-operative mode, in which case the count value in the volatile counter will get lost, the count value will be saved in the non-volatile memory and will later be used for re-initializing the volatile counter with that count value when the apparatus passes again into the operative mode. Thus, in the absence of any error events, the method according to the present invention is capable of keeping track of the exact count value. In the exceptional case when an unexpected power shutdown occurs, e.g. because of an error, there will be no time to save the current count value before the contents of the volatile counter get lost, and the count value that is stored persistently will then be the count value that has been saved last time when an integral multiple of M had been reached. Thus, in such an error scenario, the method according to the present invention will lead to a loss of up to M counts in the worst case. However, such a loss of a limited number of counts is acceptable because, if the number M has been selected appropriately, the commercial loss caused by the loss of at most M counts on the rare occasion of an error event is significantly smaller than the costs that would be required for providing sufficient storage capacity for persistently storing each individual count value.

In a next embodiment of the method according to the present invention, in a cycle of N consecutive saving steps, each memory area is written once. In addition, the method includes checking the validity of the count values stored in the non-volatile memory by checking whether the difference between two of the count values in the memory areas is not larger than M*N. As a consequence, the N memory areas of the non-volatile memory will always store the N count values that have been saved in the last N save operations. The difference between any two of these count values will always be smaller than N*M, if all count values have been saved correctly. Thus, the condition that the difference between any pair of count values that are stored in the non-volatile memory must be smaller than N*M provides a simple criterion for checking the validity of these count values. In other words, if this criterion is not met for a specific pair of count values, it must be concluded that one of the two count values is invalid, e.g. because of an error that has occurred during the write procedure.

In a further embodiment, the step of checking the validity includes identifying valid count values on the basis of the criterion that the difference between any two of the valid count values is not larger than N*M, and identifying an invalid count value on the basis of the criterion that the difference between that count value and any of the valid count values is larger than N*M. Since, normally, an error occurring during the write procedure will corrupt only one of the N count values, all pairs of count values that do not involve the one corrupted value will still fulfil the above criterion. Therefore, it is even possible to identify the invalid one among the N count values. It will be clear that, by performing the method according to the present invention, including the validity check, it is possible to identify a memory area of the non-volatile memory that has become defective. Then, it is possible to automatically continue with a modified counting procedure which leaves out the defective memory area (with M being changed to M−1). Thus, the method according to the present invention is also robust in the sense that it tolerates a failure of one or more of the N memory areas. Therefore, the system will remain robust against events of damage or failure as long as at least two EEPROM's are operating properly.

In a next embodiment of the present invention, the step of checking the validity is included, and the initialization of the counter is based only on the maximum of the valid count values. Thus, when the apparatus passes to the operative mode again, it will in most cases be possible to initialize the counter with the correct count value. In addition, even when the corrupted count value happens to be the one that had been stored last, the worst-case loss of counts will not be larger than M.

In a further embodiment of the present invention, the count value is saved in the memory area that has produced the count value with which the counter has been initialized. In principle, when the apparatus has passed into the operative mode and the counting procedure has been resumed, the first count value to be saved after an increment of M counts may be written into any of the N memory areas of the non-volatile memory. In a preferred embodiment; however, this count value is written into the memory area that has shown the largest count value in the initialization step.

If an apparatus according to the present invention includes more than one counter, e.g. counters for separately counting sheets of different formats and/or for distinguishing between simplex and duplex copies, the above method may be performed individually for each of these counters which will then have a suitable number of memory areas in the non-volatile memory associated therewith. Then, it will also be possible to count and save the total number of copies that have been made, irrespective of the format or type (simplex or duplex). In addition, another validity check may be made by comparing the sum of the count values of the individual counters to the total count value.

The present invention is also directed to an image forming apparatus that can implement the method of the present invention. Preferably, the EEPROM's are distributed over various locations within the apparatus. This will ameliorate the robustness against failures and damages.

The control system of the image forming apparatus may further include a counting control module that manages a local user interface (LUI) and/or networking with a remote accounting facility, so that the actual count values may at any time be called-up from the remote facility for billing purposes and/or may be viewed by a local user. Preferably, this control module has access to a hard disk device, which will serve as a second non-volatile memory for the count values, thereby providing more redundancy. However, since a hard disk device may be subject to damage and data loss, it is preferable that the "non-volatile memory" in the meaning of the present invention be formed by EEPROM's. On the other hand, if the count values are updated on the hard disk device on a regular basis (per counts or per time), the control unit and the hard disk may act as a server for making the count values available for the local user and the remote facility, even when the apparatus is in the non-operative mode and the power supply for the embedded software is cut off. If a reset of the control module becomes necessary, updated and correct count values may be downloaded from the EEPROM's.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 2 is a table illustrating several steps in a counting procedure according to the present invention;

DETAILED DESCRIPTION OF THE PREFERRED EMBODIMENTS

Figure 1:
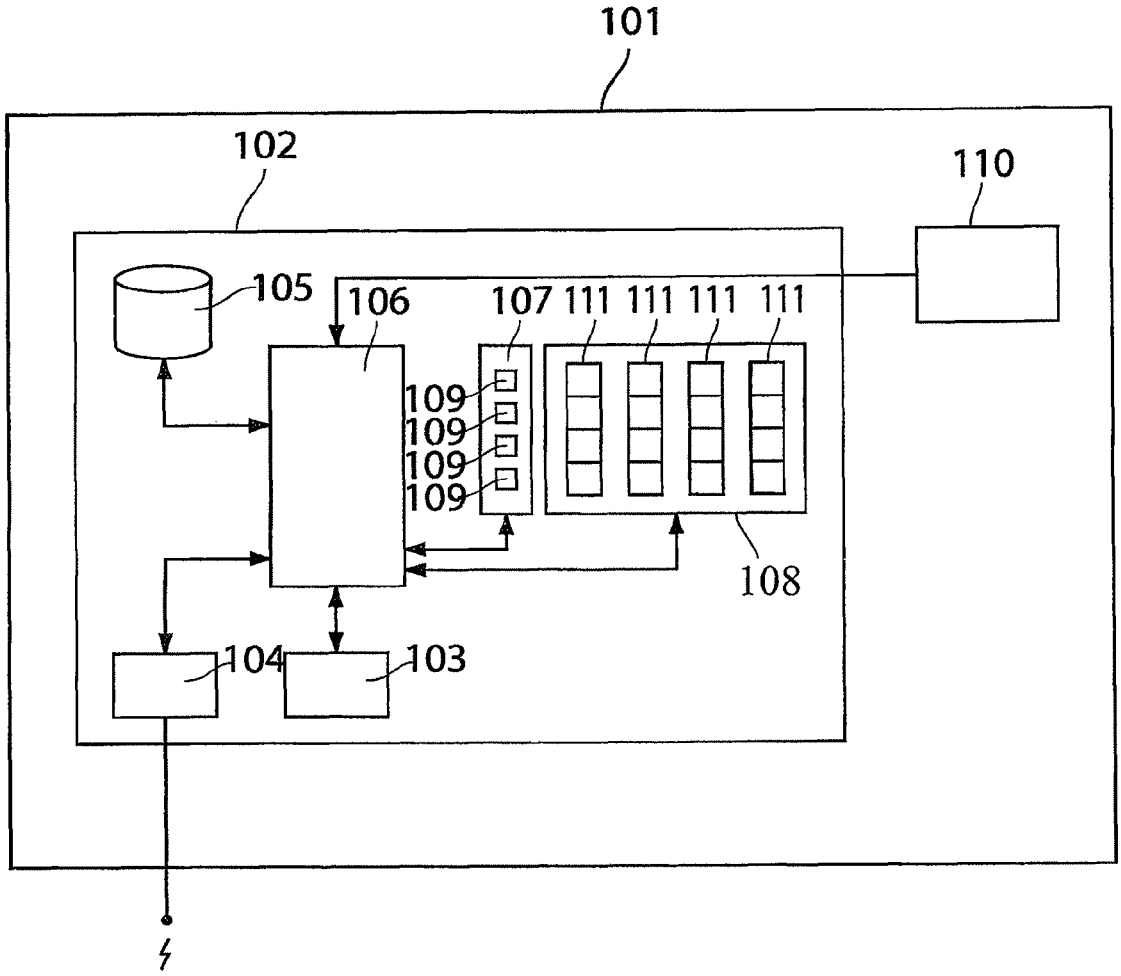
FIG. 1 is a block diagram of an image forming apparatus with a sheet counting system according to the present invention.

FIG. 1 is a block diagram of an image forming apparatus 101, which will briefly be called a "printer" hereinafter, although the apparatus may also be a copier, e.g. a digital copier, or a multi-purpose copier/printer combining the functions of scanning, copying and printing. Since the general construction and function of such an image forming apparatus are known in the art, they will not be described herein. The printer 101 has only been shown as a single block in FIG. 1. Likewise, FIG. 1 shows only those parts that are relevant to explain the present invention.

The control system 102 of the printer 101 includes a Local User Interface (LUI) 103, a network interface 104 for connection to a remote accounting facility (not shown), a hard disk device 105, a counting control module 106 connected with a volatile storage location 107 and a non-volatile memory 108. Hardware components making up the control system may be distributed over various locations in the apparatus. Volatile storage location 107 is provided with four counters 109 each of which has a volatile memory (of four bytes, for example) for storing a current count value for the number of sheets that has been printed with the printer 101. To this end, each counter 109 receives a count signal via the counting control module from a fuse unit 110 of the printer 101 each time an image has been fused on a copy sheet. The four counters 109 serve for counting small format simplex sheets, small format duplex sheets, large format simplex sheets and large format duplex sheets, respectively, on which an image has been fused on one side (simplex) or both sides (duplex) in the fuse unit 110. The storage location 107 may further include an additional counter (not shown) for counting the total number of sheets, which should always correspond to the sum of the count values of the counters 109.

When the printer passes to a sleep mode for reducing power consumption, only some parts of the control system 102 and the related peripheral devices (LUI 103, interface 104 and hard disk device 105) will be kept operative. As a consequence, the count values in the volatile memories of the counter 109 will be lost, if they are not saved to a non-volatile memory. Such a non-volatile memory 108, which is specifically dedicated the purpose of storing the count values of the counters 109, is formed by a plurality of EEPROM's 111. Each EEPROM 111 provides four 4-byte memory areas, one for each of the counters 109. A 4-byte memory area is capable of storing a count value that may be larger than 750 million counts, which is more than enough for counting all the copies made during the lifetime of the printer 101. When a count value stored in one of the memory areas is to be replaced by a new count value, the corresponding memory area of the EEPROM has to be erased, so that the new contents can be written therein. However, the lifetime of state of the art EEPROM's is limited to about one million erase and write cycles. Thus, if each count signal issued by the fuse unit 110 would be counted on the EEPROM's 111, the lifetime of the EEPROM's would expire long before the printer 101 reaches the end of its life.

It will be noted that each of the four counters 109 in the volatile storage area 107 co-operates with a total of four EEPROM's 111. However, even this 4-fold storage capacity would be far too little to store each individual count in the EEPROM's. For that reason, the counting control module 106 is so configured that, as a general rule, it stores only every 80-th count value of the counters 109 in one of the storage areas associated with a counter of one of the four EEPROM's and evenly distributes the count values over the four EEPROM's. This will virtually multiply the lifetime of the EEPROM's by 80*5=400, resulting in a counting capacity of 400 million sheets per category (per counter), which will be more than the worst case throughput of the printer 101 in six years of usage.

The specific manner in which the count values of an individual counter 109 are stored in the corresponding four memory areas each formed by a distinct EEPROM 111 will be explained in detail as the description proceeds.

In order to make the count values of the counters 109 available on the user interface 103 and the network interface 104, updates of the count values of the counters 109 are made available at a frequency of 1/min, as long as the printer is in the operating mode. Further, the current count values will be stored on the hard disk device 105 every 2.5 s. Thus, the current count values can be viewed on the user interface 103 or read from the remote accounting facility via the network interface 104, even when the printer is in the sleep mode. Additionally, day counters can be made available that can be read and reset by the user by entering appropriate commands via the LUI 103.

Although the hard disk device 105 that stores the count values that are updated once per minute is also a non-volatile memory, it will be understood that, if these count values were stored only on the hard disk device 105, they would be lost and could no longer be billed for in case of a crash of the hard disk device 105. In this respect, the non-volatile memory formed by the EEPROM's 111 provides a storage facility that will be safer and more robust.

Examples of the count and save procedures performed by the counting control module will now be described in conjunction with FIG. 2, wherein the first column represents the contents of one of the counters 109, and the second to fifth columns represent the contents of the corresponding memory areas of the EEPROM's 111. These memory areas are numerated as 0, 1, 2 and 3.

The first row (a) in FIG. 2 illustrates a condition in which the embedded software is initialized, i.e. when the printer 101 passes from the sleep mode to the operative mode.

The last count value that had been reached before the printer went into the sleep mode was 892 and is stored in area 2 in this example. The other memory areas 3, 0 and 1, in that order, show the last four count values that had been stored in the periodic save operations performed every 80 sheets. It can be seen that the increments between the values 720, 800, etc. stored in the areas 3, 0 and 1 is always equal to 80, whereas the last increment from 880 to 892 is smaller. The reason is that the value of 892 was written to the area 2 in an extra save operation when the printer went into the sleep mode, not in one of the periodic save operations. Thus, the value 892 in area 2 is the largest of the five count values that have been stored, and the counter 109 is initialized with that value.

The row (b) in FIG. 2 shows the situation 13 clicks later, when the counter has counted up to 905. It can be seen that the values in the memory areas are not changed, i.e. no save operation has been performed.

In row (c) in FIG. 2, the counter has reached 972, which is after an increment of 80 from 892. This triggers the next one of the periodic save operations. As can be seen, the count value 972 is saved in the memory area 2, i.e. the one from which the last (highest) count value 892 had been read.

The row (d) in FIG. 2 shows the situation yet another 80 clicks later, when the count value in the counter has reached 1052 and the next periodic save operation is performed. As can be seen, this count value 1052 is stored in the next memory area 3, replacing the value 720 that had previously been stored in that area.

The row (e) in FIG. 2 illustrates the situation when the printer passes again into the sleep mode while a count value of 1167 has been reached in the counter 109. In the meantime, the count values 1052 and 1132 have been saved in the areas 3 and 0 during the periodic save operations. The current count value 1167 is saved in memory area 1. When the printer is switched into the operative mode again, the counter 109 will be initialized with the value of 1167 stored in area 1, i.e. with the maximum of the four count values stored in the memory areas.

Row (f) in FIG. 2 illustrates a situation in which an unexpected power shutdown has occurred when the count value in the counter 109 had reached 1679. This unexpected power shutdown may have occurred because of an error, e.g. because the user has turned down the printer by pressing an emergency button or because of a breakdown of the line power. In the last periodic save operation, the value 1600 had been stored in memory area 0. The next periodic save operation would have taken place at a count value of 1680, and this value would have been saved in area 1. However, this save operation could not be reached because the power shutdown occurred already at 1679. As a result of the power shutdown, the counting control module has attempted to save this value of 1679 in the memory area 1, but the save operation has failed because of power shortage. Due to this failure, a senseless or random value 19631 has been stored in memory area 1.

The row (g) in FIG. 1 illustrates the situation when the printer 101 passes again into the operative mode after the unexpected power shutdown mentioned in conjunction with row (f). In this situation, the largest of the count values stored in the memory areas 0-3 is the value 19631 stored in area 1. However, by comparing this value to the count values stored in the other three memory areas, the counting control module finds that the value of 19631 can not be valid and initializes with the next largest value.

If the count and save operations are performed without any errors, as in rows (a)-(e), the difference between the count values stored in any two of the memory areas 0-3 must always be smaller than 400. This condition is not met in row (g), which shows that an error must have occurred.

It should be observed here that the erroneous count value stored in area 1 is randomly selected from among the possible count values which range from 0 to 750 million, so that there is only a negligible probability that this count value accidentally meets the above difference criterion, i.e. happens to fall within the interval between 1200 (1600−400) and 1760 (1360+400).

It can further be detected that in row (g) in FIG. 2, the values stored in the memory areas 2, 3 and 0 meet the difference criterion, and the value 19631 in area 1 is the only one that does not fit. It may therefore be concluded that only the value in area 1 is invalid, whereas the values stored in the other memory areas are valid. Thus, when searching for the maximum of the stored count values for initializing the counter 109, the memory area 1 will be excluded, so that the counter will be initialized with 1600. Since the "true" count value that was reached before the power shutdown was 1679 (row (f)), this means that 79 counts are lost and cannot be recovered. However, due to the procedure described above, such a loss of counts in case of an error will never be larger than 80. Thus, assuming that a fee of $0.01 is charged per copy, the financial damage that may be caused by such an error event will be limited to 80 cents.

The row (h) illustrates the situation that is reached another 160 clicks later. The count value in the counter (which is still 79 counts too small) has reached 1760. In the periodic save operation that has taken place at 1680, this count value has again been stored in the memory area 0 from which the value of 1600 for initialization had been read, as was described above. In the next periodic save operation occurring at 1760, the erroneous value in area 1 is overwritten with 1760, so that all traces of the error are removed.

In order to avoid errors of the type illustrated in row (f), it would be possible to adapt a hardware configuration that maintains a sufficient power voltage level for correctly saving the count value to the EEPROM until the write operation is completed, even in case of an unexpected power shutdown. In most cases; however, such a hardware configuration will not be necessary because the loss of only 80 counts in the worst case will be acceptable.

It will be appreciated that the validity check and (approximate) error correction procedure described above does not depend upon the specific type of error that has caused the wrong storage value in one or more of the memory areas. For example, this procedure will also be effective if a wrong result is stored in one of the memory areas because the corresponding EEPROM has reached the end of its lifetime. Since the five memory areas associated with an individual counter 109 are formed by or located on different EEPROM's, the failure of one EEPROM will not affect the results stored in the other EEPROM's.

In order to prevent fraud, a normal user will of course not have the possibility to reset the EEPROM's. However, authorised personnel, e.g. a service engineer, may have appropriate tools for resetting the EEPROM's, for example when the printer 101 is refurbished and thus has a "second life." Considering normal usage of the printer 101, the lifetimes of the EEPROM's will be sufficient for a second or even a third life of the printer without exceeding the maximum number of erase/write cycles.

The procedures performed by the embedded software in conjunction with initializing the counter, counting the clicks and saving the count results will now be described in detail with reference to FIGS. 3 and 4.

Figure 3:
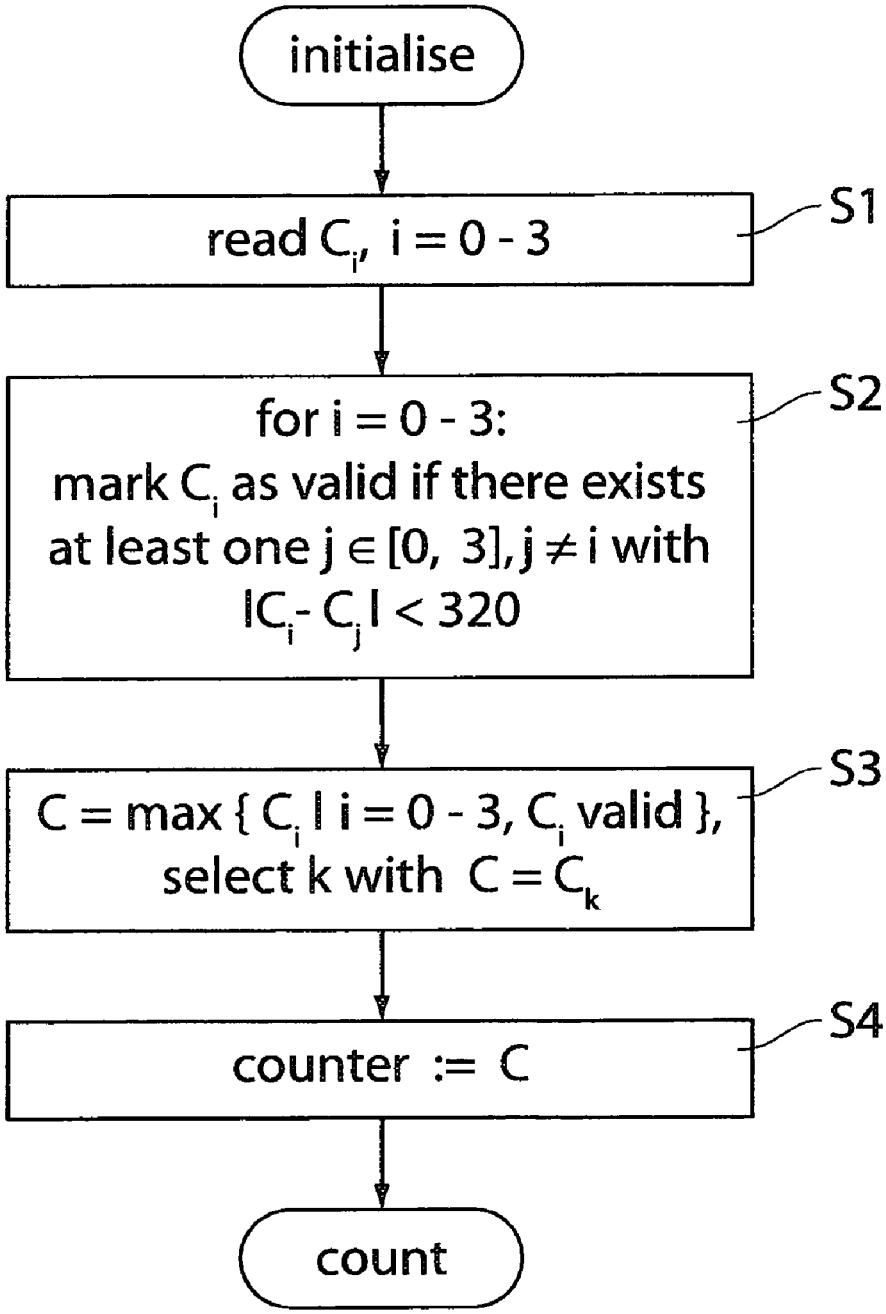
FIG. 3 is a flow diagram illustrating a procedure for initializing a counter in the system shown in FIG. 1.

FIG. 3 is a flow diagram for an initializing routine that will be performed each time the printer 101 passes from the sleep mode to the operative mode. In step S1, the count values $C_i$ are read from the four memory areas 0-3. Step S2 is the validity check, wherein each of the count values $C_i$ is compared to each of the other three count values $C_j$, to check whether their difference is smaller than 320. In the example shown, a count value $C_i$ is considered to be valid if there exists at least one other count value $C_j$ for which the difference criterion is met. Thus, if the total number M of memory areas is 4, the system would still be operative if three of the five EEPROM's are defective.

A subsequent step S3 searches for the maximum C among the valid count values $C_i$ and stores an index k, which points to the memory area in which the highest count value had been stored. Then, in step S4, the counter 109 is initialized with the maximum C found in step S3, and the routine passes on to the count procedure that is illustrated in FIG. 4.

In step S5, it is checked whether a shutdown condition is met, i.e. whether a command for starting a regular shutdown procedure has occurred, so that the printer will pass into the sleep mode or will be switched off completely. A command for entering into the sleep mode may, for example, be generated automatically when the printer has not been used for a predetermined time interval.

If no shutdown condition is met, it is checked in step S6 whether a new click has occurred, i.e. whether a count signal has been received from the fuse unit 110. The steps S5 and S6 are repeated cyclically as long as the printer remains in the operative state and no new click occurs. In case of a new click, the loop is left via step S7, where the previous count value C in the volatile memory of the counter 109 is increased by one. Then, it is checked in step S8 whether the count value has been incremented in step S7 with a multiple of 80. If this is not the case, the routine loops back to step S5.

On the other hand, if the count value has been incremented with a multiple of 80, the routine branches to step S9 where this count value is written into the EEPROM memory area with the index k (which was initialized in step S3), and the former value of k is replaced by (k+1) mod3. This assures the cyclic switching of the memory areas 0-3 to which the count values are written, as was described in conjunction with FIG. 2.

Then, if no shutdown condition was met in step S5, the routine loops back to step S5 via step S10, and the count procedure is continued.

If a shutdown condition is detected in step S5, the routine branches directly to step S9 to store the current count value, as in row (e) in FIG. 2. Then, the procedure is ended via step S10, and it will be only then that the shutdown procedure leads to the power supply for the embedded software being cut off. Thus, under normal conditions, it is assured that the save operation will be performed correctly.

Figure 4:
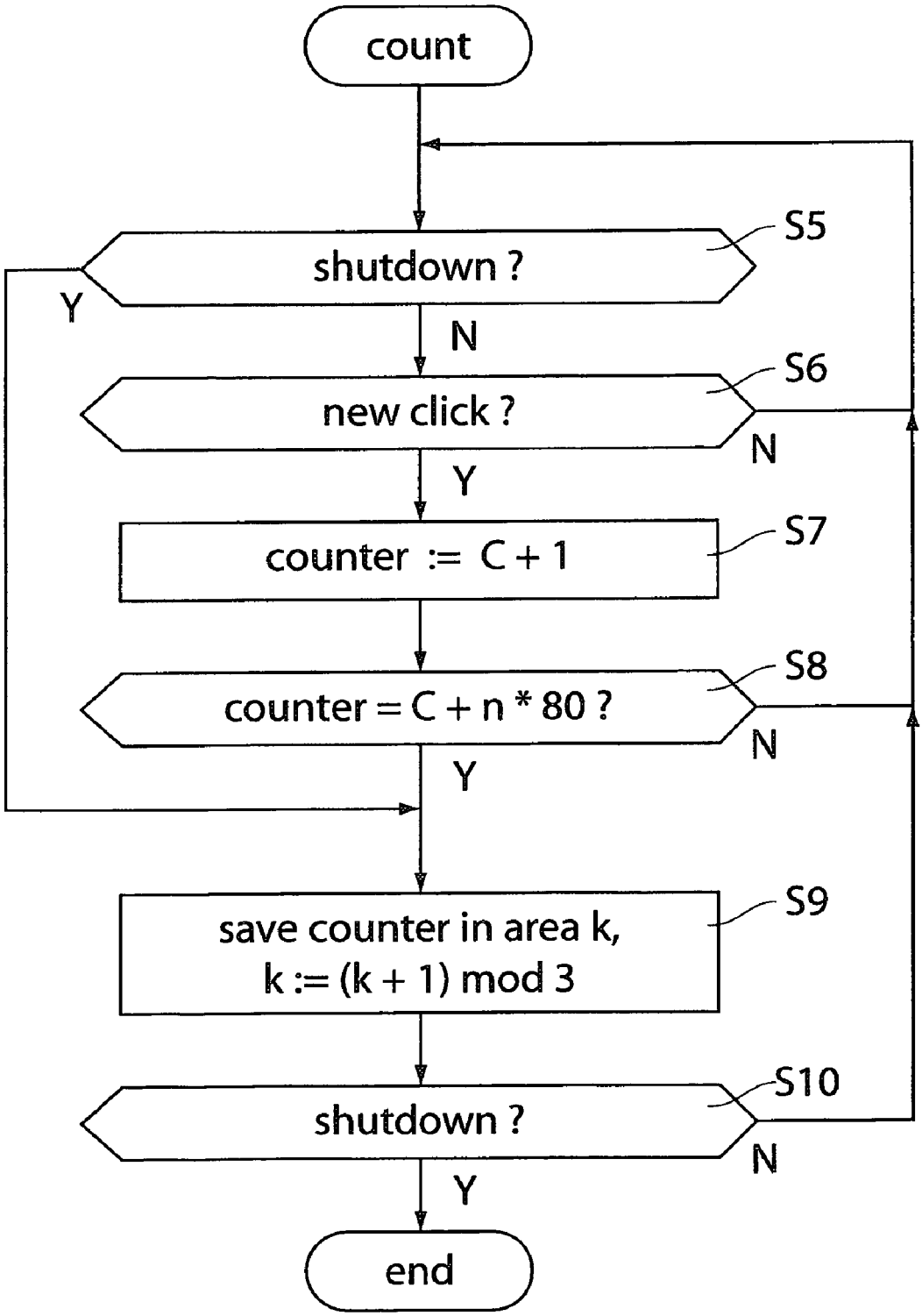
FIG. 4 is a flow diagram illustrating a counting procedure according to the present invention.

As an alternative for the embodiment shown in FIG. 4, it is proposed to save count values at multiples of 80. In FIG. 4 step S8 will then check the condition "has the counter reached a value that is a multiple of 80?" If yes, the method proceeds with step S9; if no the method returns to step S5. Row (h) in FIG. 2 represents a typical configuration in which the differences between all the count values stored in the memory areas 0-3 are multiples of 80. It is an advantage of this embodiment that the differences between all count values are multiples of 80. This condition must always be fulfilled if the number of counts that has occurred since the last power start-up of the embedded software becomes larger than 320. This can be used as a criterion that is easy to check and therefore permits a simple and fast validity check that may replace a more complex checksum or other validity check procedure.

In continuation now of the embodiment shown in FIG. 4, the embedded software may not attempt to save a current count value if an unexpected shutdown occurs. Then, unlike the example illustrated in row (f) in FIG. 2, the contents of the pertinent memory area 1 would be left as it is (at 1360). However, in the next initialization step (row (g)), the value 1600 would still be the highest valid count value. The further procedure would be the same as in row (h). The only difference would be that it would not be possible to conclude from the invalidity of at least one count value that a loss of up to 80 counts has occurred. Of course, such a condition which implies a possible loss of counts may be detected by other means, as is well known in the art. A situation comparable to the one shown in rows (f) and (g) in FIG. 2 may however occur when the pertinent EEPROM is defective or when the power supply happens to be cut off in the very moment in which the save operation (step S9) is performed.

The validity check performed in step S2 in FIG. 3 may be extended to include a procedure for identifying the memory area that has produced an invalid count value. This information may be passed on to the control module 106 where the error may be recorded in a log file. Thus, if a specific EEPROM malfunctions and produces invalid results repeatedly, this may be detected in the control module 106, and the control module may disable that EEPROM or memory area and continue with a modified count procedure utilizing only the remaining, non-defective memory areas.

The control module 106 may further be used for performing additional checks. For example, if the printer has a maximum production rate of 180 copies per minute (summed over all sheet formats), then the difference between the last count value stored in the hard disk device 105 for a specific counter 109 and the next update for that counter cannot be larger than 180, since the count values are updated in the control module 106 once per minute. Thus, if an unreasonably large difference is detected or if the count value appears to have decreased, this is an indication that an error has occurred in the counting system. If the printer has been in the sleep mode in the interval between the last and the last but one update, it is likely that the error has occurred in the EEPROM write procedure or the initialization procedure. Such events may be recorded on the log file and/or may cause the control module 106 to send an error message to the accounting facility via the network interface 104.

The behaviour of the system will now be illustrated in conjunction with a number of possible error scenarios.

As was explained already, in case of an uncontrolled shutdown of a running system, not more than 80 clicks will be lost in the worst case. If a failure occurs in the initialization of the control system 102, and this control system has to be restarted, the count values stored in the counters 109 will be lost, and the count values that are shown on the LUI 103 immediately after restart will not be correct. However, the values stored in the EEPROM's 111 will serve as a backup, and the control module 106 will be updated with the correct count values after one minute of operation of the printer. In that case, no clicks will be lost.

In case of a hardware or software failure, the count values in the volatile memories of the counters 109 will be made persistent. Thus, when a service technician has replaced defective parts and/or has reloaded the software for the control system, the correct count values will be written into the counters 109 in the first initializing procedure shown in FIG. 3, and no clicks will be lost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus, comprising:

a control system adapted to switch the apparatus from a non-operative mode to an operative mode and vice versa and including at least one volatile memory counter, and a non-volatile memory with a plural number N of memory areas associated with each volatile memory counter, each non-volatile memory area for every volatile counter implemented on a separate EEPROM device, wherein the control system comprises:

a control system component for initializing the volatile memory counter with a maximum of the count values stored in the plural number N memory areas, when the apparatus passes into the operative mode;

a control system component for counting events with the volatile memory counter; and a control system component for saving a volatile memory count value to one of the non-volatile memory areas, wherein the volatile memory count value is saved to one of the plural number of N memory areas implemented on a separate EEPROM device when the volatile memory count value has been incremented by a predetermined number M (M>1) or when the apparatus passes into the non-operative mode.

2. The apparatus according to claim 1, further comprising a control system component for writing each memory area once when the volatile memory count value has been saved N times.

3. The apparatus according to claim 2, further comprising a control system component for checking the validity of the count values stored in the non-volatile memory by checking whether a difference between two of the count values in the memory areas is not larger than M*N.

4. The apparatus according to claim 3, wherein the control system component for checking the validity identifies valid count values stored in the non-volatile memory on the basis of the criterion that the difference between any two of the valid count values stored in the non-volatile memory is not larger than N*M, and identifying an invalid count value on the basis of the criterion that the difference between that count value and any of the valid count values is larger than N*M.

5. The apparatus according to claim 2, wherein the initialization of the counter is based only on the maximum of valid count values stored in the non-volatile memory.

6. The apparatus according to claim 1, wherein the volatile memory count value is saved in the memory area that has produced the count value with which the counter has been initialized.

7. The apparatus according to claim 1, wherein the volatile memory count value is saved with each time cycling switching of the memory area into which the volatile memory count value is written.

8. The apparatus according to claim 1, wherein the non-volatile memory is incorporated in an embedded software architecture, and the memory areas of the non-volatile memory are distributed over various locations within the apparatus.

9. A method for counting a number of images formed by an apparatus having a control system adapted to switch the apparatus from a non-operative mode to an operative mode and vice versa and including at least one volatile memory counter, and a non-volatile memory with a plural number N of memory areas associated with each volatile memory counter, each non-volatile memory area for every volatile counter implemented on a separate EEPROM device, comprising:

initializing the volatile memory counter with a maximum of the count values stored in the plural number N memory areas, when the apparatus passes into the operative mode;

counting events with the volatile memory counter; and saving a volatile count value to one of the plural number of N memory areas implemented on a separate EEPROM device when the volatile memory count value has been incremented by a predetermined number M (M>1) or when the apparatus passes into the non-operative mode.

* * * * *